US012484645B1

(12) United States Patent
Avasarala et al.

(10) Patent No.: US 12,484,645 B1
(45) Date of Patent: Dec. 2, 2025

(54) FACE MASK AND SHIELD COMBINATION

(71) Applicant: Aver Technologies, Inc., Woodbridge, VA (US)

(72) Inventors: Pallavi Avasarala, Woodbridge, VA (US); Pranav Avasarala, Woodbridge, VA (US); Manya Aanika Yellepeddy, Woodbridge, VA (US); Yuvaan Manohar Yellepeddy, Woodbridge, VA (US)

(73) Assignee: Aver Technologies, Inc., Woodbridge, VA (US)

( * ) Notice: Subject to any disclaimer, the term of this patent is extended or adjusted under 35 U.S.C. 154(b) by 0 days.

(21) Appl. No.: 18/943,509

(22) Filed: Nov. 11, 2024

Related U.S. Application Data

(60) Provisional application No. 63/674,114, filed on Jul. 22, 2024.

(51) Int. Cl.
*A41D 13/11* (2006.01)
*A41D 13/015* (2006.01)

(52) U.S. Cl.
CPC ..... *A41D 13/1184* (2013.01); *A41D 13/0158* (2013.01)

(58) Field of Classification Search
CPC ..... A41D 13/1184; A41D 13/1115; A41D 13/1107; A41D 13/11; A62B 18/205; A62B 18/08
See application file for complete search history.

(56) References Cited

U.S. PATENT DOCUMENTS

| | | | | |
|---|---|---|---|---|
| 5,406,944 | A * | 4/1995 | Gazzara | A62B 18/082 128/201.12 |
| 5,584,078 | A * | 12/1996 | Saboory | A41D 13/1184 2/427 |
| 11,318,333 | B1 * | 5/2022 | Ellerbrake | A62B 23/02 |
| 2021/0298387 | A1 * | 9/2021 | De La Guardia | A41D 13/1161 |
| 2021/0345706 | A1 * | 11/2021 | Kaltenbach | A41D 13/1161 |
| 2021/0402227 | A1 * | 12/2021 | Swonger | A41D 13/1161 |
| 2022/0346474 | A1 * | 11/2022 | Avasarala | A62B 18/08 |
| 2023/0120007 | A1 * | 4/2023 | Green | A41D 13/1184 2/9 |
| 2023/0181946 | A1 * | 6/2023 | Kalaitzis | B01D 39/18 128/206.19 |

* cited by examiner

*Primary Examiner* — Patrick J. Lynch
*Assistant Examiner* — Brianna T. Duckworth
(74) *Attorney, Agent, or Firm* — Bookoff McAndrews, PLLC

(57) ABSTRACT

An assembly is provided. The assembly may include a face mask to conform to a face of a user, the face mask including an adapter including one or more venting pathways to alter a direction of one or more exhaled gasses traveling in an initial direction. An assembly may include a face shield, the face shield selectively engageable with the face mask. An assembly may include a connector including a magnetic engagement structure to couple the face mask to the face shield in a predetermined orientation.

16 Claims, 11 Drawing Sheets

FACE MASK AND SHIELD COMBINATION

CROSS-REFERENCE TO RELATED APPLICATION

This application claims priority to provisional application 63/674,114, filed Jul. 22, 2024, the disclosure of which is incorporated by reference herein in its entirety.

TECHNICAL FIELD

Aspects of this disclosure relate generally to protection systems, devices, and methods. More specifically, embodiments of the disclosure relate to a protection system (e.g., combined face mask and shield) for directing and/or filtering air and/or particulates being inhaled and/or exhaled by a user. The combined face mask and shield may be useful in the medical field, in the construction field, or in any other suitable field requiring face protection.

BACKGROUND

Protection devices such as face masks, face shields, and the like are worn by a user in many fields (e.g., medical, construction, etc.) to protect the user from air particulates, including, for example, dust, bacteria, viruses, allergens, spores, coarse particles, debris, etc. A mask helps to protect a user from air particulates by surrounding a user's mouth and nose and filtering air that is inhaled. For example, the mask may be a cloth or other material that covers the user's mouth and nose. However, during exhalation, the exhaled air remains within the confines of the mask, or a portion of the exhaled air is directed forward of the user. Shields are worn to protect a portion of a user's face from air particulates. Shields often include a band that wraps around the user's head such that the shield extends in front the user's face. The shield helps to protect the user's eyes and face from air particulates or debris. Shields also are rigid and/or fixed relative to the user's face, which requires the user to completely remove the shield to access the user's face, for example, to adjust the user's glasses. Additionally, as the user exhales, the shield becomes foggy, which impair the user's eyesight. Even if the user is wearing a mask, the shield still becomes foggy since the exhaled air exits the front of the mask. Additionally, the shield moves and/or separates from the user's head when attached by a single band around the user's head. Masks also move and/or separate from the user's face, for example, when the user adjusts the attachment strap(s), talks, moves the user's mouth, etc. Furthermore, wearing both a shield and mask concurrently is time-consuming and/or difficult to adjust, manipulate, etc.

The systems, devices, and methods of the current disclosure may address one or more of the deficiencies described above.

SUMMARY

Examples of the present disclosure relate to, among other things, wearable face coverings (e.g., combined mask and face shield assemblies), devices, and methods to direct and/or filter air and/or air particulates being inhaled and/or exhaled by a user while also protecting the user's face from debris. In one example, the combined mask and shield may protect the wearer's face from flying objects at constructions sites (e.g., chipped concrete) and also protect the user from inhaling dust. In some examples, the face shield or screen may be shatter-proof or otherwise shatter-resistant. Each of the examples disclosed herein may include one or more of the features described in connection with any of the other disclosed examples.

In some aspects, the techniques described herein relate to a system including: a face mask to conform to a face of a user, the face mask including one or more venting pathways to alter a direction of one or more exhaled gasses traveling in an initial direction; a face shield, the face shield selectively engageable with the face mask; and a connector including a magnetic engagement structure to couple the face mask to the face shield in a predetermined orientation.

In some aspects, the techniques described herein relate to a system including: a base; an adapter to connect to the base, the adapter including one or more venting pathways to direct a flow of air; a coupler to interface with the adapter, the coupler including one or more venting slots to align with the one or more venting pathways; and a cap to attach to one or more of the adapter or the coupler, the cap including one or more openings and one or more conduits to alter a direction of the air traveling in an initial direction into the adapter.

In some aspects, the techniques described herein relate to a system including: a shield to deflect airborne particulates; and a connector to attach the shield to a face mask, the connector including: one or more arms including one or more end connectors to retain one or more edges or corners of the shield, and one or more engagement elements including one or more of one or more magnetic elements or one or more friction fit connectors.

The foregoing and other objects are intended to be illustrative of the disclosure and are not meant in a limiting sense. Many possible embodiments of the disclosure may be made and will be readily evident upon a study of the following specification and accompanying drawings comprising a part thereof. Various features and subcombinations of disclosure may be employed without reference to other features and subcombinations. Other objects and advantages of this disclosure will become apparent from the following description taken in connection with the accompanying drawings, wherein is set forth by way of illustration and example, an embodiment of this disclosure and various features thereof.

BRIEF DESCRIPTION

The accompanying drawings, which are incorporated in and constitute a part of this specification, illustrate exemplary features of the present disclosure and together with the description, serve to explain the principles of the disclosure.

DETAILED DESCRIPTION

As required, a detailed embodiment of the present disclosure is disclosed herein; however, it is to be understood that the disclosed embodiment is merely exemplary of the principles of the disclosure, which may be embodied in various forms. Therefore, specific structural and functional details disclosed herein are not to be interpreted as limiting, but merely as a basis for the claims and as a representative basis for teaching one skilled in the art to variously employ the present disclosure in virtually any appropriately detailed structure.

Embodiments of the present disclosure may relate to a protection system for directing and/or filtering air and/or particulates being inhaled and/or exhaled by a user. Various embodiments described herein may include a protection system that includes a mask and a shield. For example, the mask may be a face mask, and the shield may be a face shield. More specifically, in exemplary embodiments, the protection system may include a combined mask and shield, and may be configured to direct outward airflow rearward, for example, away from the shield. The airflow may be directed rearward, for example, by one or more vented slots and a cap. Additionally, the mask may have horizontal ribs on its interior, creating separation from a surgical mask and allowing air to travel sideways away from the face shield.

Figure 1A:
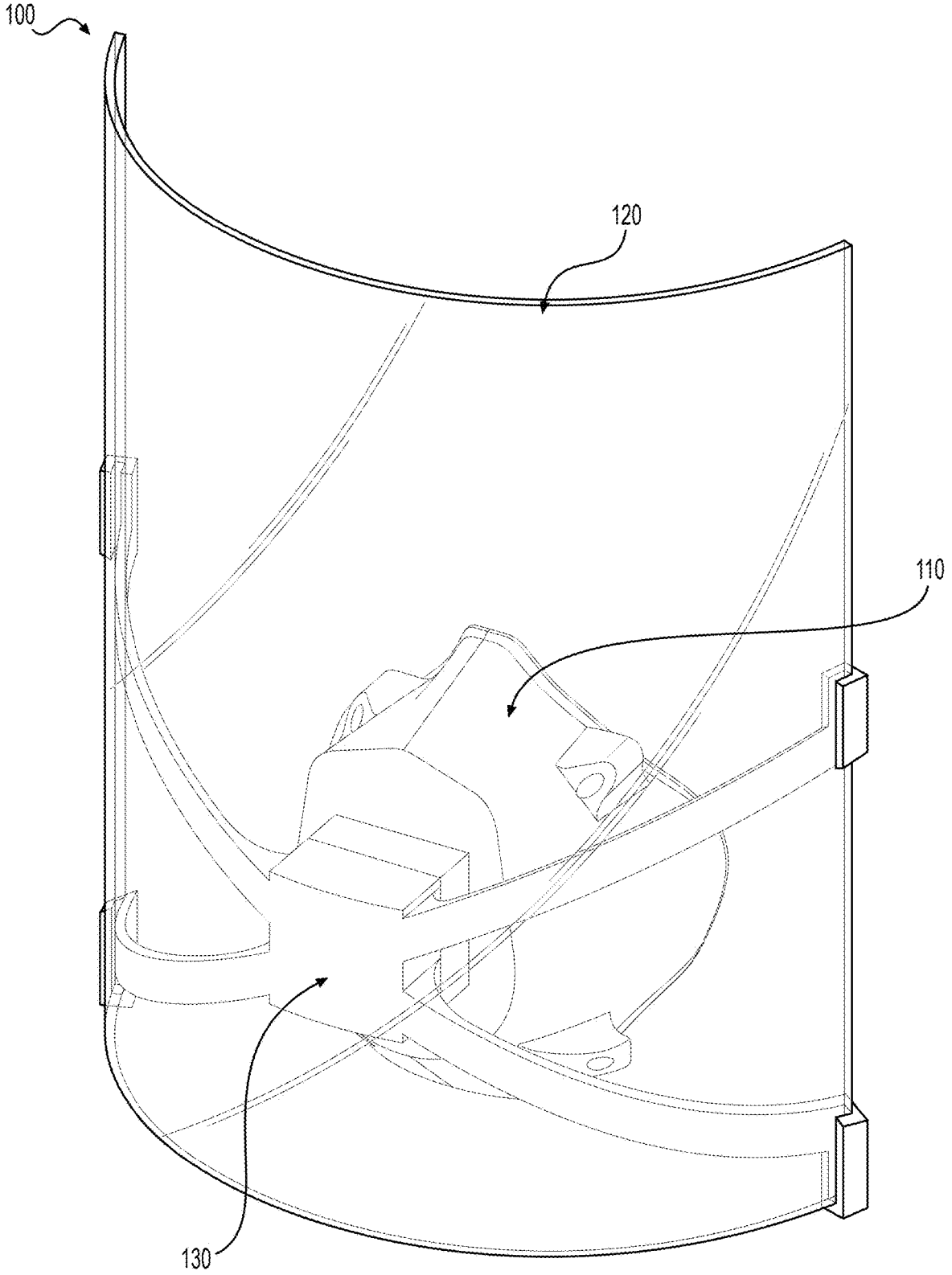
FIG. 1A illustrates an exemplary protection system/wearable face covering including a mask, a shield, and a connecting structure in an assembled configuration, according to some embodiments of the disclosure.
Figure 1B:
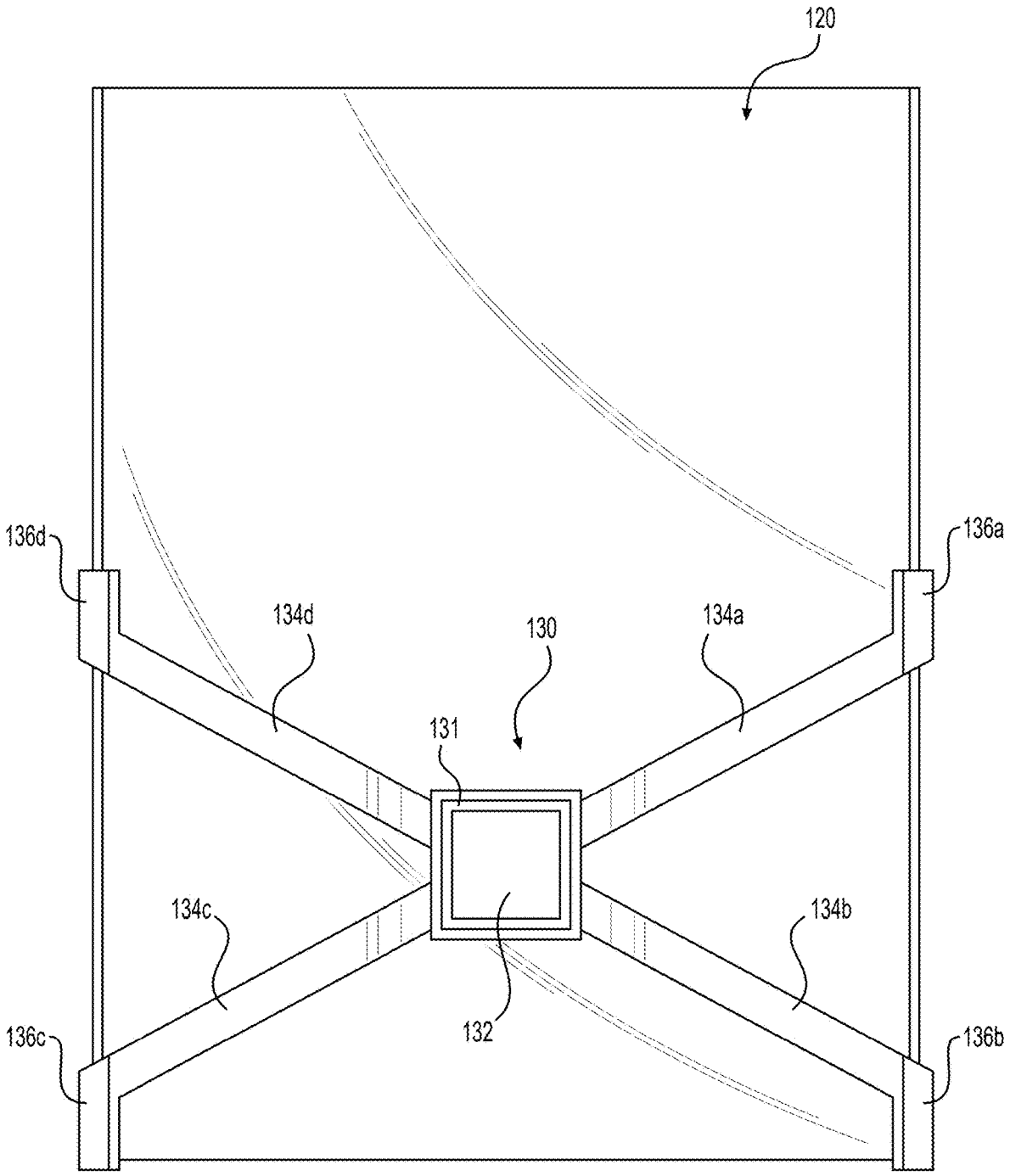
FIG. 1B illustrates a rear elevation view of the shield and connecting structure, according to some embodiments of the disclosure.

FIGS. 1A and 1B depict a protection system 100 that includes a mask 110, a shield 120, and a connecting structure 130. Protection system 100 may protect a user's face from outside air particulates (e.g., dust, bacteria, viruses, allergens, spores, coarse particles, etc.) and/or other debris. FIGS. 1A and 1B illustrate protection system 100 in an assembled configuration. As depicted, mask 110 and shield 120 may be coupled together, for example, by way of connecting structure 130. Additionally, connecting structure 130 may be selectively received by one or more portions of mask 110, and may itself selectively receive shield 120.

In some embodiments, the connecting structure 130 serves as a versatile interface between the mask 110 and the shield 120, enabling the selective attachment and detachment of the shield 120. The connecting structure 130 may be configured to provide a secure hold on the shield 120 while allowing for quick release and reattachment as required. This feature may be particularly beneficial in dynamic environments where the nature of air particulates and debris exposure may change rapidly, necessitating quick adaptation of protective equipment. The arms 134*a*-134*d* of the connecting structure 130, which extend radially from the central portion 132, are configured with respective receiving elements 136*a*-136*d* that may engage with the edges or corners of the shield 120. This design may facilitate an effective tensioned engagement of the shield 120, maintaining the shield in a flexed, operative position relative to the mask 110.

Mask

Figure 2:
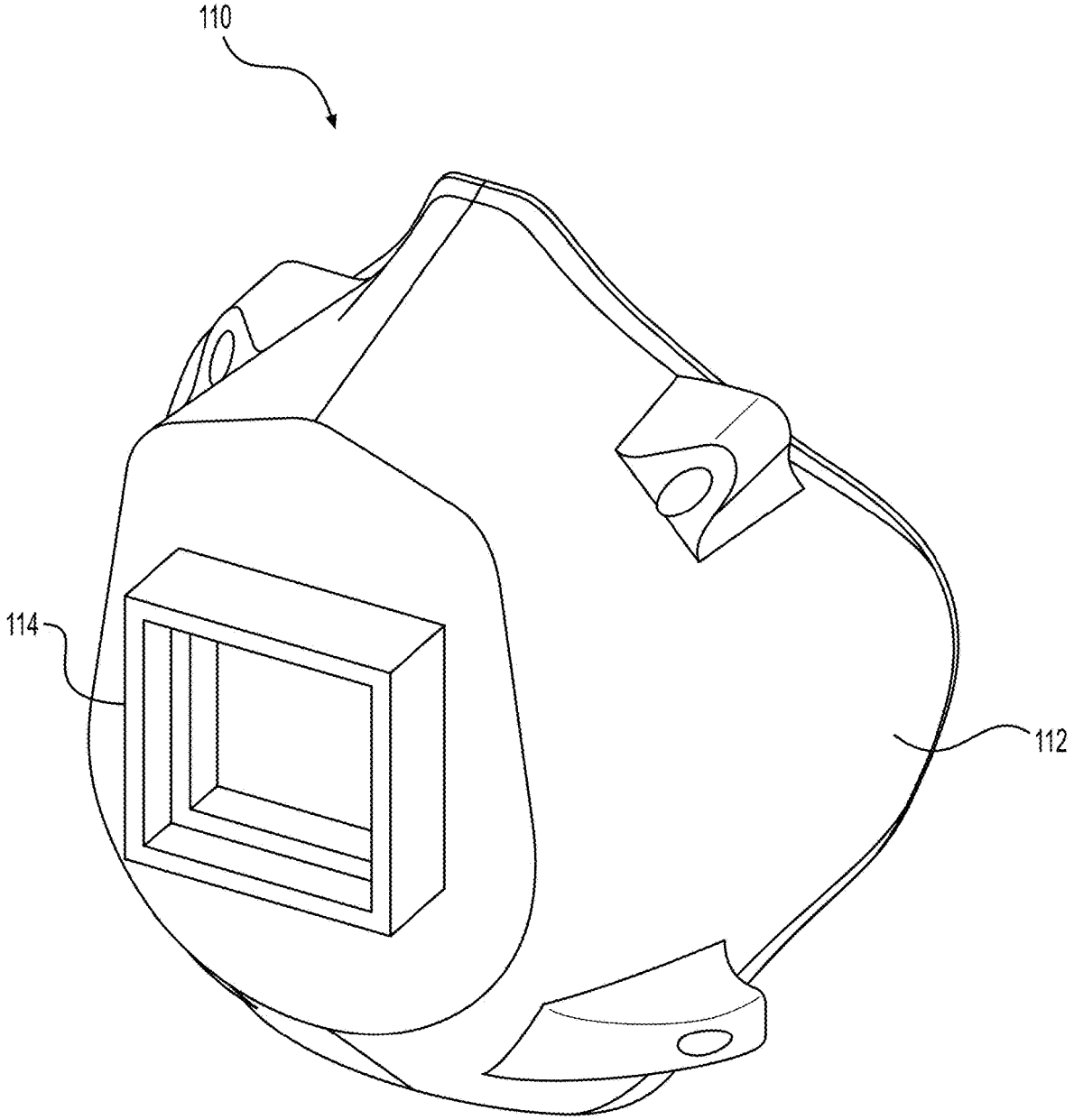
FIG. 2 illustrates the mask, according to some embodiments of the disclosure.
Figure 6:
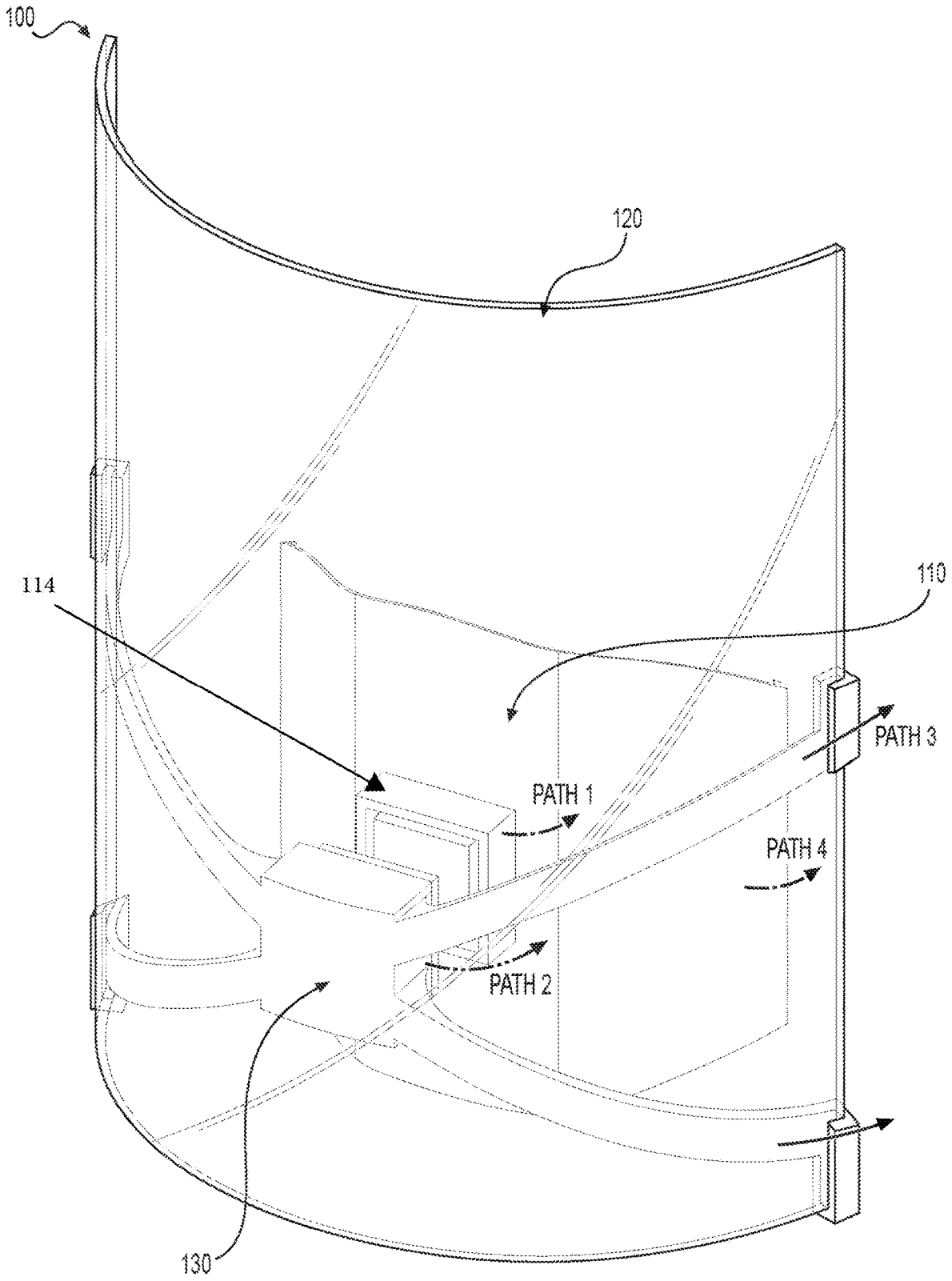
FIG. 6 illustrates a perspective view of the protection system with one or more indicators of one or more venting pathways, according to some embodiments of the disclosure.

FIG. 2 illustrates an embodiment of the mask 110, which is a component of the protection system 100. In some embodiments, the mask 110 may include a body portion 112 and an adapter 114. The body portion 112 may be contoured to conform to the user's face, thereby creating a sealed environment that reduces unfiltered air from being inhaled. The adapter 114 may be engineered to interface with the central portion 132 of the connecting structure 130. The adapter 114 may incorporate various forms of attachments, including, but not limited to, friction fit, locking mechanisms, or magnetic couplings, to ensure a secure and yet detachable connection with the connecting structure 130. Mask 110 may be configured as an underlying protective surface, such as a sub-shield, as depicted in FIG. 6.

The mask 110 may be comprised of a body portion 112 that may be anatomically contoured to cover the nose and mouth of a user, providing a protective barrier against inhalation of airborne particulates. The body portion 112 may be fabricated from materials suitable for creating an effective seal against the user's face, while also offering comfort during extended wear. Furthermore, the body portion 112 may include an exterior surface configured to interface with other components of the protection system 100, such as the connecting structure 130.

The adapter 114 is depicted as a centrally featured element on the mask 110, and may be fashioned as a singular unit or an assembly of multiple structures (as discussed below), capable of receiving the central portion of the connecting structure 130. This adapter 114 may be engineered to align and retain the connecting structure 130 in a predetermined orientation, ensuring the stability and functionality of the shield 120 when mounted. Additionally, the adapter 114 may be integrated with one or more magnets to facilitate a magnetic coupling, offering a quick and reliable method of attachment and detachment. The magnetic interaction between the adapter 114 and the connecting structure 130 may be finely tuned to provide sufficient retention force while allowing for the ease of selective disengagement by the user.

In some embodiments, the adapter 114 may be further equipped with one or more venting pathways. These pathways may be realized as slots or other similar structures within the adapter 114, arranged to channel exhaled air away from the user's face, which may reduce fogging of the shield 120 and improve the comfort level. The design of the venting pathways may be optimized to direct the airflow in a specific pattern, contributing to the overall functionality of the mask 110 by managing the interior microclimate and mitigating the ingress of external particulates.

Figure 3:
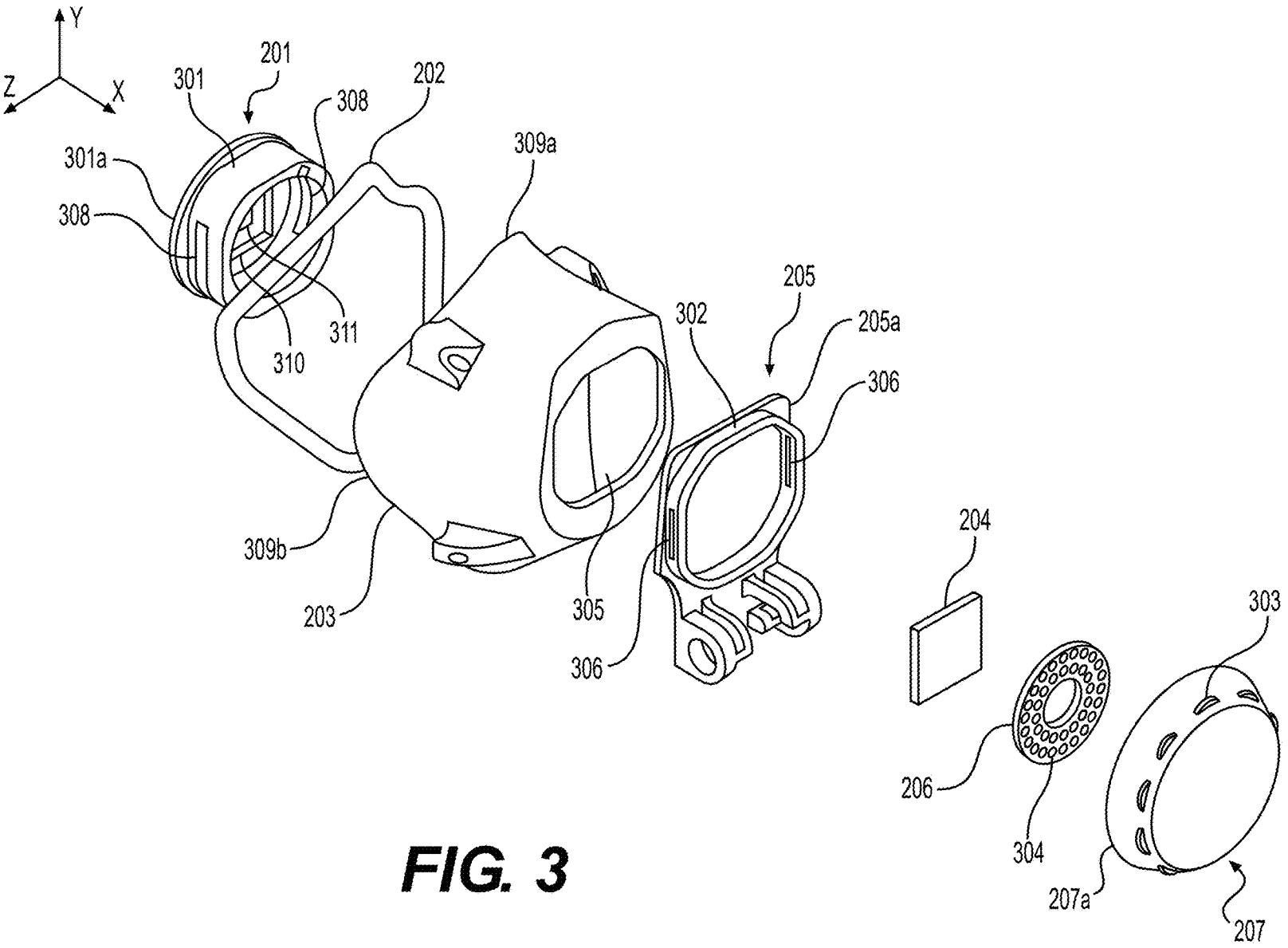
FIG. 3 illustrates an exploded view of the mask, according to some embodiments of the disclosure.
Figure 4A:
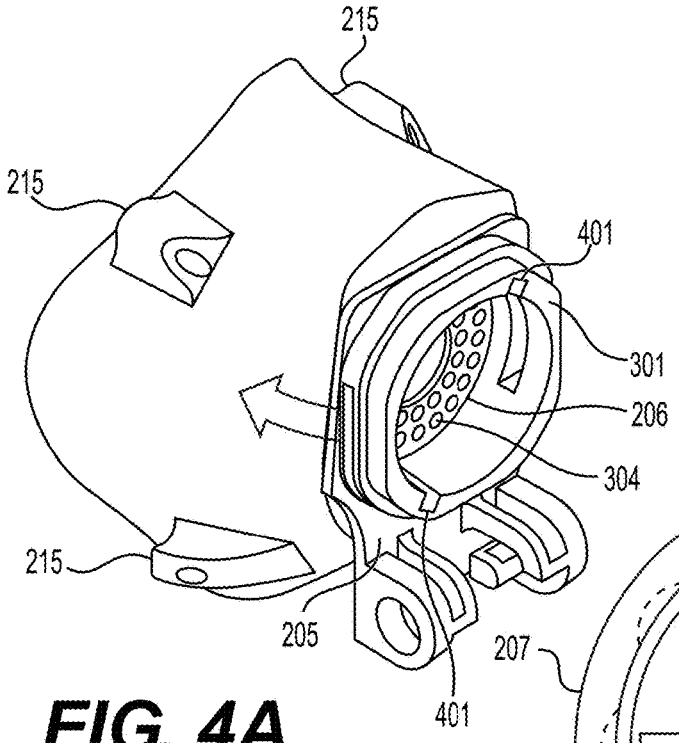
FIG. 4A illustrates a perspective view of portions of the assembled mask.
Figure 4B:
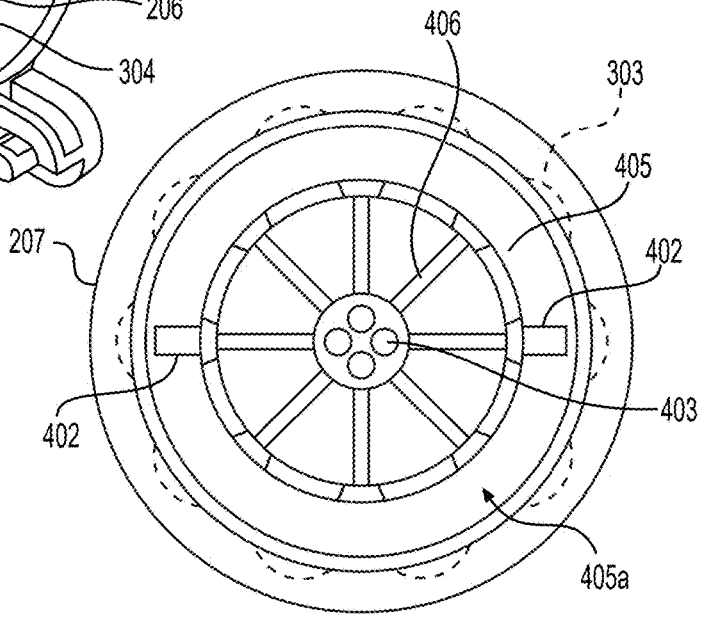
FIG. 4B illustrates an end view of an inside of a cap.

Referring to FIG. 3, an embodiment of mask 110 is depicted. In this embodiment, mask 110 may be an at least partially flexible filtration mask, for example, to form a seal around at least a portion of a user's nose and face. Mask 110 may include a disk or a cap 207 to direct airflow. In one or more aspects, cap 207 may direct air rearwards and/or away from shield 120 when the user exhales. Cap 207 may direct exhaled air rearward and prevent exhaled air from passing forward of the user's face. As depicted in FIG. 4B, cap 207 may also include one or more openings 403 positioned centrally within the cap 207, for example, to allow airflow in through sides of mask 110 during an inhale by the user.

As discussed in detail below, mask 110 may include a number of components or elements fitted or otherwise coupled together. For example, mask 110 may include a base 203, cap 207, and coupler 205. Base 203 may include an interior at least partially enclosing an interior volume, and an exterior. Base 203 may be configured to fit around a user's mouth and nose. For example, as depicted in FIG. 3, base 203 may include a partially circular portion 309*b*, for example, to surround a user's mouth, and an extension portion 309*a*, for example, to surround a user's nose. In this aspect, partially circular portion 309*b* and extension portion 309*a* may surround a user's mouth and nose when the user wears mask 110. Base 203 may be coupled to coupler 205 via one or more of an adhesive, a snap fit, a press fit, etc.

Base 203 may include a plurality of retention holes 215. Retention holes 215 may allow for one or more retention elements (not depicted) to be positioned around the user's head, ears, face, etc. to couple mask 110 to the user's face. Retention elements, not depicted, may include one or more strings, bands (e.g., an elastic band), straps, threaded knobs, etc. Base 203, for example, may include one or more retention holes 215 on each lateral side of base 203. As depicted in FIGS. 2-4*c*, base 203 may include two retention holes 215 on each lateral side of base 203. Although only one side of base 203 is depicted in these figures, it is noted that the other side of base 203 may also include two retention holes 215. In these aspects, one or more retention elements, not depicted, may pass through each of retention holes 215, and be secured to base 203, for example, via one or more knots, one or more clips, one or more adjustable buckles, etc. Retention element(s), not depicted, may then be positioned around the user's head, ears, face, etc. to couple mask 110 to the user's face.

Cap 207 may be coupled to one or more other components of mask 110. As discussed with respect to FIGS. 4A and 4B, cap 207 may be coupled to one or more components of mask 110 via a screw-fit. For example, cap 207 may include one or more keys 402 (FIG. 4B) positioned on an inner portion of cap 207, and the one or more keys 402 may be received within corresponding keyways. Cap 207 may also include a plurality of grips 303 positioned on an outer portion of cap 207. Coupling cap 207 to one or more other components of mask 110 may retain mask 110 and/or protection system 100 in the assembled configuration.

As depicted in FIGS. 3 and 4A-4C, mask 110 may further include an adapter 201, a filter 204, a seal 202, and a mask disk 206. Adapter 201 may include a coupling portion 301 that extends from a front of adapter 201. Adapter 201 may be inserted from an interior side of base 203, through a central opening 305 so that coupling portion 301 extends outward of base 203. Adapter 201 may include a flange 301*a* extending circumferentially around adapter 201. Flange 301*a* may be a portion of adapter 201 that is closest to a face of the user when the mask 110 is worn, and may abut an inner surface of base 203 to retain adapter 201 to base 203.

Coupling portion 301 may include an exterior with a shape that is different from that of its interior. The exterior may be substantially octagonal, and the interior may be substantially circular. As depicted in FIGS. 2 and 3, the exterior may include alternating rounded portions and straight portions. Central opening 305 of base 203 may have a shape corresponding to the shape of the exterior of coupling portion 301.

Coupling portion 301 may include one or more vertical slots 308, for example, to allow air to flow into and out of mask 110. Slots 308 may be positioned on opposing sides of coupling portion 301. For example, slots 308 may extend from opposing vertical portions (e.g., opposing straight portions) of the exterior of coupling portion 301. Slots 308 may be formed by substantially rectangular openings (vents) extending in the vertical direction of side portions of coupling portion 301. Although a rectangular shape is depicted, the shape of slots 308 should not be considered limited thereto, and other suitable shapes, such as ovular, circular, square or the like also are contemplated. Slots 308 on sides of adapter 201 may to direct airflow, for example, as air is drawn into mask 110 during inhalation and/or as air is pushed out of mask 110 during exhalation. For example, slots 308 may allow for mask 110 to draw air in from the sides of adapter 201 and/or direct air out of the sides of adapter 201 (e.g., in the positive and negative directions of the z-direction). In these aspects, the air passing through slot(s) 308 may be directed toward (e.g., when exhaled) and/or have passed through (e.g., when inhaled) filter 204.

Adapter 201 may also contain recessed portion 310, for example, in a center of adapter 201, which faces outward and away from the user. Recessed portion 310 may be any shape suitable of containing and/or receiving a portion of a filter 204. For example, if filter 204 is square or rectangular (as depicted), then recessed portion 310 may also be square or rectangular. Furthermore, adapter 201 includes an adapter opening 311 at the center of the adapter and extending through recessed portion 310, and extending in the x-direction. In this aspect, filter 204 may be received in recessed portion 310 so that air flowing through adapter opening 311 must pass through filter 204. Accordingly, during inhalation, air must pass through filter 204 and through adapter opening 311 to the user. Similarly, during exhalation, air must pass through adapter opening 311 and filter 204 from the user.

Although not depicted, if filter 204 is substantially circular, then recessed portion 310 may also be substantially circular. Filter 204 may be configured to filter air particulates from air passing through filter 204, for example, during inhalation and exhalation. As discussed below, filter 204 may be a replaceable and/or reusable filter. Filter 204 may be replaced, for example, by removing cap 207.

Seal 202 may be coupled to an interior periphery of base 203. Seal 202 and other components of mask 110 may ensure that air flowing to and/or from the user's face (e.g., the user's mouth and nose) passes through filter 204.

As mentioned above, coupler 205 is positioned between base 203 and cap 207. Coupler 205 may have a venting portion 302 thereon extending in the x direction. Venting portion 302 may include venting slots 306 on opposing sides of the venting portion 302. When mask 110 is assembled, each slot 306 may align with a slot 308 of adapter 201, so that inhaled/exhaled air travelling through a given slot 306 must also travel through an immediately adjacent slot 308 and vice versa.

Coupler 205 may be coupled to base 203, for example, by press fit when cap 207 is coupled to adapter 201. For example, coupler 205 may include an abutting portion/flange 205*a* that abuts an outward face of base 203. Coupler 205 may be in contact with coupling portion 301 of adapter 201, when coupling portion 301 extends through base 203. For example, coupler 205 may receive a portion of coupling portion 301 of adapter 201, and a portion of coupling portion 301 may extend distally beyond coupler 205, for example, farther from the user in the positive x-direction. The exterior of coupling portion 301 may contact an interior face of venting portion 302. Venting portion 302 may have an inner shape substantially similar to the exterior shape of coupling portion 301. For example, inner shape of venting portion 302 may correspond to the alternating straight and rounded portions of the exterior of coupling portion 301.

As depicted in FIGS. 2 and 3, disk 206 may be configured to fit within coupling portion 301 of adapter 201. In this aspect, if coupling portion 301 has a substantially circular interior shape, mask disk 206 may also be substantially circular. As depicted in FIG. 4A, disk 206 may be positioned within coupling portion 301, for example, in a position distal to (i.e., in the positive x-direction relative to) filter 204. Disk 206 may retain filter 204 relative to adapter 201, for example, such that filter 204 is retained at least partially within recessed portion 310. Filter 204 may be positioned and configured to prevent rotation of the filter while cap 207 rotates. Disk 206 may include a plurality of through-holes 304. Through-holes 304 may allow for air to flow through disk 206, and thus through filter 204, during inhalation and exhalation.

Securing cap 207 to adapter 201 may retain filter 204 and disk 206 within the mask assembly. As mentioned above and as depicted in FIGS. 4B and 4C, cap 207 may include one or more keys 402. One or more keys 402 may extend from an outer ring of a central portion of cap 207. The central portion may include an inner ring 405 with a central hub 405*a*. Central hub 405*a* may include one or more openings 403. The openings 403 may be in fluid communication with a plurality of conduits 406 that extend radially outward from the central hub 405*a*. The conduits 406 may terminate at an outer circumference of inner ring 405. In the assembled configuration, inner ring 405 may be received within the interior of adapter 201. Therefore, exhaled air from the user travels through the one or more openings 403, then through the one or more conduits 406, and then through slots 308 and 306, into the atmosphere.

Furthermore, the interior of coupling portion 301 may include one or more key slots 401, which extend in the x direction and which are coupled to slots 308. Key slots 401 (and slots 308) may receive a portion of cap 207 to secure the mask assembly together. Key slots 401 may each include a longitudinal portion extending in the x direction that connect to slots 308. Key slots 401 may be positioned approximately 180 degrees apart from one another in the interior of coupling portion 301. In order to couple cap 207 to coupling portion 301 of adapter 201, keys 402 of cap 207 may be aligned with key slots 401. Cap 207 may be advanced longitudinally, for example, in the negative x-direction, which may also advance keys 402 longitudinally within key slots 401. Cap 207 may then be rotated after keys 402 are prevented from further longitudinal movement, for example, clockwise, which may rotate keys 402 into slots 308. After this rotation, cap 207 may be secured to adapter 201, further securing base 203, coupler 205, filter 204, and disk 206 between cap 207 and adapter 201.

Figure 5:
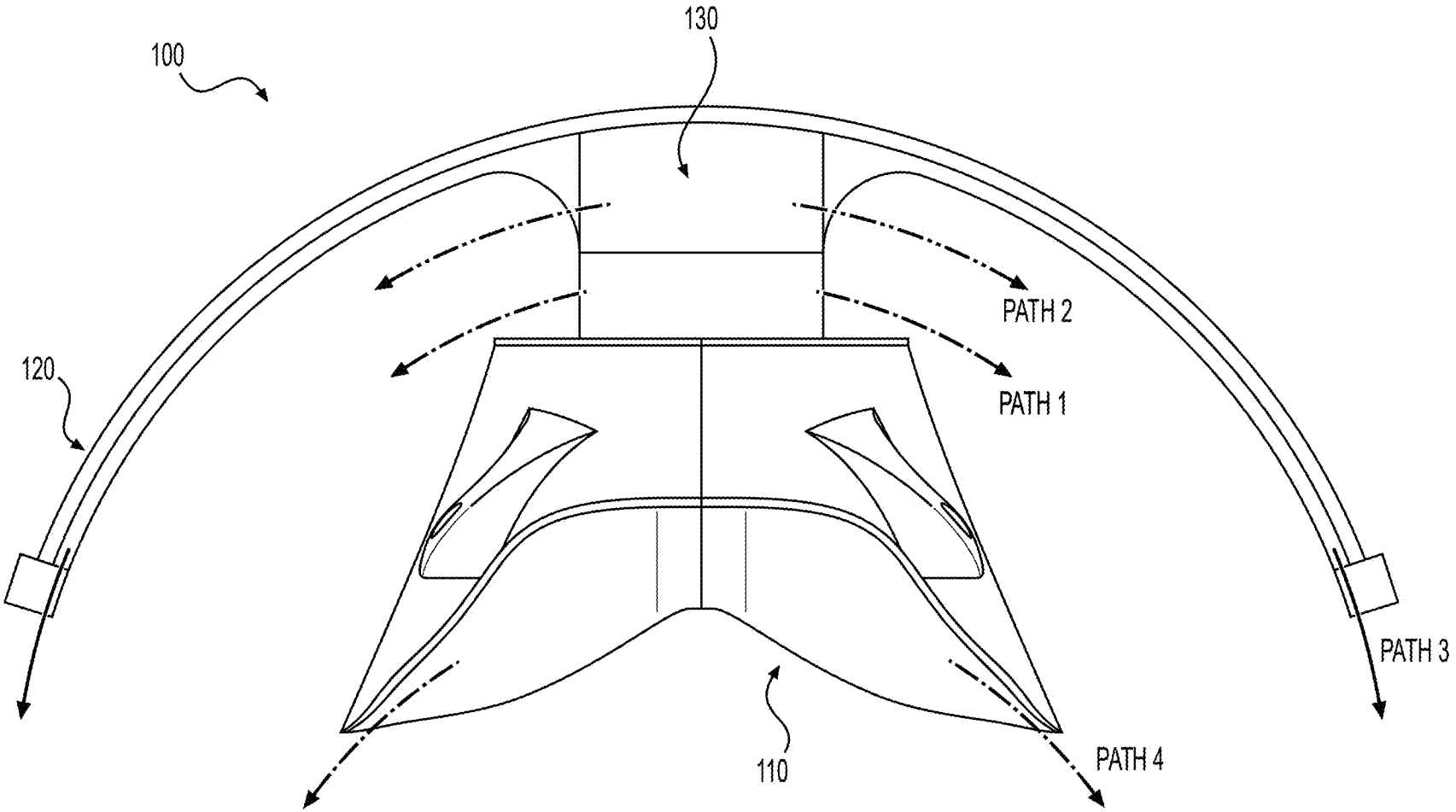
FIG. 5 illustrates a top plan view of the protection system with one or more indicators of one or more venting pathways, according to some embodiments of the disclosure.

Thus, coupling cap 207 to adapter 201 may couple the other components of mask 110. For example, as depicted in FIG. 5, coupling cap 207 to adapter 201 may provide a clamped assembly. Furthermore, when cap 207 is coupled to coupling portion 301 of adapter 201, cap 207 directs exhaled air back toward the user's ears, instead of in the forward direction. In some embodiments, cap 207 may be configured to substantially or entirely prevent the flow of exhaled air from travelling in the forward direction (away from the user). Cap 207 may achieve this result by virtue of a closed front end (without any holes, openings, or gaps, extending through its front surface). Furthermore, cap 207 may include a conical skirt 207*a* that further diverts air exhaled through slots 306 and 308 rearward toward the user's ears and face. In some embodiments, air exiting mask 110 does not include any component travelling in the forward/positive X direction.

FIG. 5 illustrates a top plan view of the protection system with one or more indicators of venting pathways, according to some embodiments of the disclosure. Notably, the mask 110 may include one or more horizontal ribs (not shown) on its interior surface. These horizontal ribs are configured to create a separation between the mask 110 and a surgical mask worn underneath. This separation forms venting pathways that facilitate the directional flow of exhaled air. When a user exhales, the air is directed through the space created by these ribs, channeling it sideways and away from the face shield 120. This design helps to prevent the shield from fogging and maintains a clear field of vision for the user. The horizontal ribs thus provide a pathway, such as path 4, which may be a primary pathway for the exhaled air, effectively displacing it to the sides of the protection system, while additional pathways (Path 1, Path 2 and Path 3) may further assist in managing airflow and enhancing the comfort and functionality of the mask and shield combination.

In some embodiments, the horizontal ribs on the interior surface of the mask 110 may be strategically positioned to optimize airflow and ensure efficient venting. These ribs can be arranged in parallel rows extending horizontally across the mask's interior, from one lateral edge to the other. The ribs may be designed to follow the contour of the mask, ensuring they do not compromise the comfort or fit for the user. In some embodiments, the ribs may be hollow, forming internal channels that facilitate the movement of air. These internal channels may align with one or more venting pathways of other components, such as the adapter 201 or the coupler 205, creating a continuous airflow route that directs exhaled air away from the user's face and the face shield 120.

In some embodiments, the positioning of the horizontal ribs can vary depending on the specific design of the mask 110. For instance, the ribs may be concentrated around the mouth and nose areas, where airflow is most intense, to maximize their venting efficiency. Alternatively, the ribs could extend across a larger portion of the interior surface, providing a more distributed airflow management system. The ribs may also include apertures or slots that align with corresponding openings in other components, such as the adapter 201's venting slots 306 and 308. This alignment ensures that air traveling through the ribs' internal channels can seamlessly flow into the mask's primary venting pathways, further enhancing the overall ventilation system. The ribs' hollow structure not only aids in airflow management but also adds structural integrity to the mask, helping to maintain its shape and fit during use. The materials used for the ribs can be flexible yet durable, allowing for both comfort and long-term use without degradation.

Moreover, cap 207 may be removable, for example, to access filter 204. With cap 207 separated from adapter 201, the user may access disk 206 and/or filter 204, for example, to adjust, inspect, clean, replace, etc. disk 206 and/or filter 204.

As mentioned above, FIG. 4A depicts mask 110 in a partially assembled configuration. As depicted, when adapter 201 and coupler 205 are coupled, slots 308 of adapter 201 and venting slots 306 of coupler 205 are at least partially aligned. Although only one side of assembled mask 110 is depicted in the figures, it is noted that both sides of adapter 201 and coupler 205 may have slots 308 and venting slots 306 aligned. For example, aligning the slots 308 with venting slots 306 may allow air to flow from exterior of mask 110 to an interior of mask 110 and to filter 204, for example, as the user inhales. For example, aligning the slots 308 with venting slots 306 may allow air to flow from inside mask 110 to filter 204 and out of mask 110 via the aligned slots 308 and venting slots 306, for example, as the user exhales.

Connecting Structure

The connecting structure 130 may be an assembly configured to facilitate the secure attachment and positioning of the shield 120 relative to the mask 110. In some embodiments, the central portion 132 of the connecting structure 130 may integrate one or more features of the components depicted in FIGS. 3 and 4A-4C, such as elements from cap 207 or coupler 205. The central portion 132 may provide a stable base from which the arms 134*a*-134*d* radiate, and may include structures that enhance the coupling integrity with the mask 110.

Figure 4C:
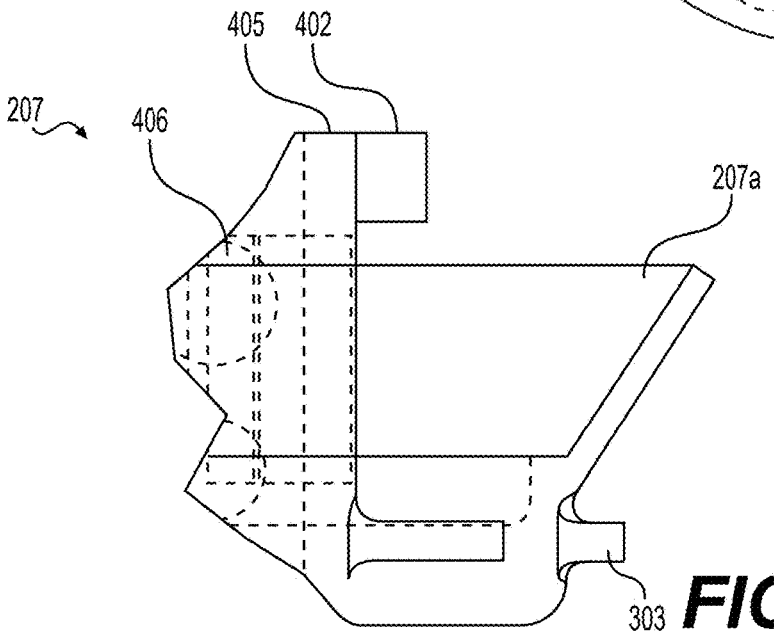
FIG. 4C illustrates a detailed section view of the cap.

In particular, the central portion 132 may incorporate magnetic elements that align with corresponding magnetic features integrated within one or more elements of mask 110 or one or more elements depicted in FIGS. 3-4C. These magnets may create a magnetic field strong enough to hold the connecting structure 130 in place during use, yet allow for intentional decoupling when the user desires to remove or adjust the shield 120. The magnetic interaction may ensure that the connection is not only robust, but also user-friendly, allowing for quick adaptation without the need for excessive force or complicated disassembly processes.

In some embodiments, the magnetic connection between the central portion 132 and the face shield 120 may allow for the removal of the shield without the need to take down the mask 110. This feature can be particularly advantageous in environments where a hand of a user may be occupied during a time frame where it is advantageous to remove the face shield 120, such as dental offices. Typically, removing or attaching a face shield in such settings may require the use of both hands, complicating the process. However, with the magnetic connection, the user can remove and reattach the face shield 120 with a single hand. This configuration can facilitate quick and easy adjustments, enhancing the convenience and usability of the protection system 100. The magnetic engagement mechanism can be designed to provide sufficient holding force to maintain the shield in place during use, while also enabling effortless detachment when needed.

The central portion 132 of the connecting structure 130 may also be configured to include a friction fit connector 131 that works in tandem with mask 110. This friction fit may include a system of interlocking ridges and grooves or a compressible material that conforms to the shape of one or more components of mask 110 when engaged, which may provide a snug and secure fit that prevents unintentional detachment. The friction fit components may provide an added layer of security, ensuring that the shield 120 remains stably affixed to the mask 110 even in the presence of vigorous movement or external forces.

The arms 134*a*-134*d* of the connecting structure 130 may serve as the primary interface for securing the shield 120. Each arm of arms 134*a*-134*d* may terminate in a receiving element, which may include a clip, slot, c-shaped element, or other configuration conducive to engaging with the edge or corner of the shield 120. These receiving elements may be fashioned from a durable material that provides sufficient elasticity to allow the shield 120 to snap into place while also maintaining the tension needed to keep the shield 120 in its flexed, protective position. In some embodiments, the arms 134*a*-134*d* may include adjustable features that allow for the accommodation of shields of varying thicknesses or flexibilities. This adjustability may be implemented via sliding mechanisms, screw adjustments, or resilient clips that may be manually expanded or contracted to secure the shield 120 firmly.

Further to the adaptability of the connecting structure 130, the central portion 132 may integrate elements from coupler 205, such as venting portions or attachment flanges. These integrated elements may enhance the structural cohesiveness of the connection and may serve dual functions, such as aiding in airflow management or serving as a locking mechanism to secure the connecting structure 130 to the mask 110. The central portion 132 may facilitate air circulation within the protection system 100. The central portion 132 may feature pathways or channels that align with the venting pathways of the mask 110, such as those found in the adapter 201, coupler 205, or one or more other element of mask 110, to direct exhaled air away from the shield 120, which may reduce the likelihood of fogging. The central portion 132 may, in some embodiments, include a plurality of vents or slots that correspond with and/or align with those in mask 110.

Shield

The shield 120 may serve as a protective barrier that may be selectively coupled with the mask 110 via the connecting structure 130, and may be configured to deflect and filter air particulates and other debris away from the user's face. This shield 120 may be fabricated from a transparent or semi-transparent material, enabling full visibility while offering protection. The curvature of the shield may be maintained in a flexed configuration by engagement with the receiving elements (136*a*-*d*) on the arms (134*a*-*d*) of the connecting structure 130, thus providing a contoured fit around the user's face. The material and thickness of the shield 120 may be selected to provide a balance between rigidity, for maintaining shape and creating an effective barrier, and flexibility, to ensure user comfort and adaptability to varying facial contours or movements.

Venting Pathways

Referring to FIGS. 5 and 6, in some embodiments, the venting pathways within the protection system 100 may manage the flow of exhaled air, directing the air away from the shield 120 to minimize fogging and to control the internal microclimate of the mask 110. These pathways may alter or facilitate the redirection of airflow, or gasses, traveling in an initial direction in a manner that leverages the structure of the mask 110 and the connecting structure 130, which may provide user comfort and clarity of the shield 120.

In some embodiments, the venting pathways may be entirely contained within one or more structures of mask 110, as discussed above. This configuration utilizes the structures of the mask 110, to channel exhaled air towards the back and sides, in a direction away from or orthogonal to a plane of the inner surface of the shield 120. This design may ensure that the airflow is managed without necessitating additional pathways in the connecting structure 130, which may simplify the overall design and may reduce the manufacturing complexity and cost.

In some embodiments, the venting pathways may extend from the mask 110 through the central portion of the connecting structure 130. Here, elements from the mask 110, for example, cap 207 or coupler 205 as depicted in FIGS. 3 to 4C, may be incorporated into the central portion and may be configured to align with complementary structures on the mask 110 when the connecting structure 130 is engaged. The alignment of these elements may provide continuous channels that guide exhaled air through the mask 110 and out via strategically placed slots in the central portion, effectively directing the airflow in a controlled manner while maintaining the structural integrity of the connection.

In some embodiments, the arms of the connecting structure 130 may house conduits that provide part of the venting pathways. Air may be drawn or expelled from the mask 110 into these arm conduits and exits through openings located on the rearward-facing surface of the receiving elements. This approach may effectively redirect the air around the periphery of the shield 120, which may ensure that the shield 120 remains free from condensation and that the airflow does not directly impact the user's field of vision.

Such arm conduits may be configured as integral parts of the arms, utilizing the space within each arm to channel airflow without adding significant bulk or complexity to the connecting structure 130. The conduits within the arms may account for the flexure and tension of the arms, which may ensure that airflow is not impeded when the shield 120 is attached or adjusted.

In some embodiments, one or more structures associated with the mask 110 or the connecting structure 130 may incorporate one-way valves, such as flapper valves or duckbill valves, which may be situated within the venting pathways or conduits. These valves may be configured to permit the unidirectional flow of air, which may ensure that exhaled air is expelled in a controlled manner along the designated conduits, while preventing the external air from entering through the same pathways. The inclusion of one-way valves may enhance the protective qualities of the system by maintaining the filtration integrity during inhalation and contributes to the effective management of airflow during exhalation.

In some embodiments, one or more horizontal ribs on the interior surface of mask 110 may be positioned to manage the flow of exhaled air within the protection system 100. These ribs can create narrow channels that facilitate the directed movement of air. By maintaining a consistent separation between the mask 110 and an underlying surgical mask, the horizontal ribs can guide exhaled air sideways along their length. This configuration may help to prevent the air from traveling directly forward towards the face shield 120, thereby minimizing the potential for fogging and maintaining the user's visibility. The ribs' placement and orientation may follow the contour of the user's face, providing both comfort and effective airflow management.

In some embodiments, the horizontal ribs may be hollow, incorporating internal channels that align with one or more venting pathways of other components within the mask 110. These channels may facilitate the movement of air through the mask 110 and can align with the venting slots in the adapter 201 and the coupler 205, creating a continuous pathway for air to travel through. This alignment may ensure that exhaled air is effectively channeled away from the user's face and the face shield 120, reducing condensation and maintaining a clear field of vision. The ribs' hollow structure can aid in airflow management and add structural integrity to the mask 110.

In some embodiments, the horizontal ribs may be distributed across various portions of the interior surface of mask 110. Some ribs may be concentrated around the mouth and nose area to handle the bulk of the exhaled air, while others may extend across the cheeks and towards the sides of the mask. This distribution can create multiple pathways for air to escape, ensuring a balanced and consistent airflow. Additionally, the ribs may include apertures or slots that further enhance their venting capabilities. These openings can be strategically placed to align with corresponding structures in the adapter 201 or the coupler 205, facilitating an unimpeded flow of air through the mask 110 and out of the venting pathways. The combination of hollow ribs, internal channels, and aligned apertures can create a comprehensive system for managing exhaled air, ensuring both user comfort and the functionality of the protection system 100.

In some embodiments, the protection system 100 may include multiple venting paths to manage the flow of exhaled air, ensuring effective airflow management and user comfort. The primary venting path may be associated with the horizontal ribs on the interior of mask 110. These ribs can create channels that direct exhaled air sideways, utilizing the separation between the mask 110 and an underlying surgical mask to facilitate the movement of air away from the face shield 120. Path 4 may effectively reduce the potential for fogging on the shield, thereby maintaining clear visibility for the user.

In some embodiments, additional venting paths can work in conjunction with Path 4 to further enhance airflow management. Path 1 may be defined by the space created between the mask 110 and the surgical mask due to the horizontal ribs. This path can direct air laterally across the user's face, away from the shield 120. Path 2 may involve venting slots or channels in the adapter 201 that align with the horizontal ribs' internal channels, allowing exhaled air to be channeled through the mask and out through the adapter. Path 3 may include additional slots or openings in the coupler 205, which can further direct the airflow out of the mask and away from the user's face.

In some embodiments, these venting paths can be designed to complement each other, providing a comprehensive system for managing exhaled air. Path 4 associated with the horizontal ribs may handle the bulk of the airflow, while paths 1, 2, and 3 can provide supplementary routes for air to escape. This multi-path approach may ensure that exhaled air is efficiently directed away from the face shield 120 and the user's face, enhancing comfort and functionality. The alignment of the various paths can create a seamless flow of air through the mask 110, adapter 201, and coupler 205, ensuring that the protection system 100 effectively manages airflow and reduces the potential for condensation on the face shield.

Figure 7A:
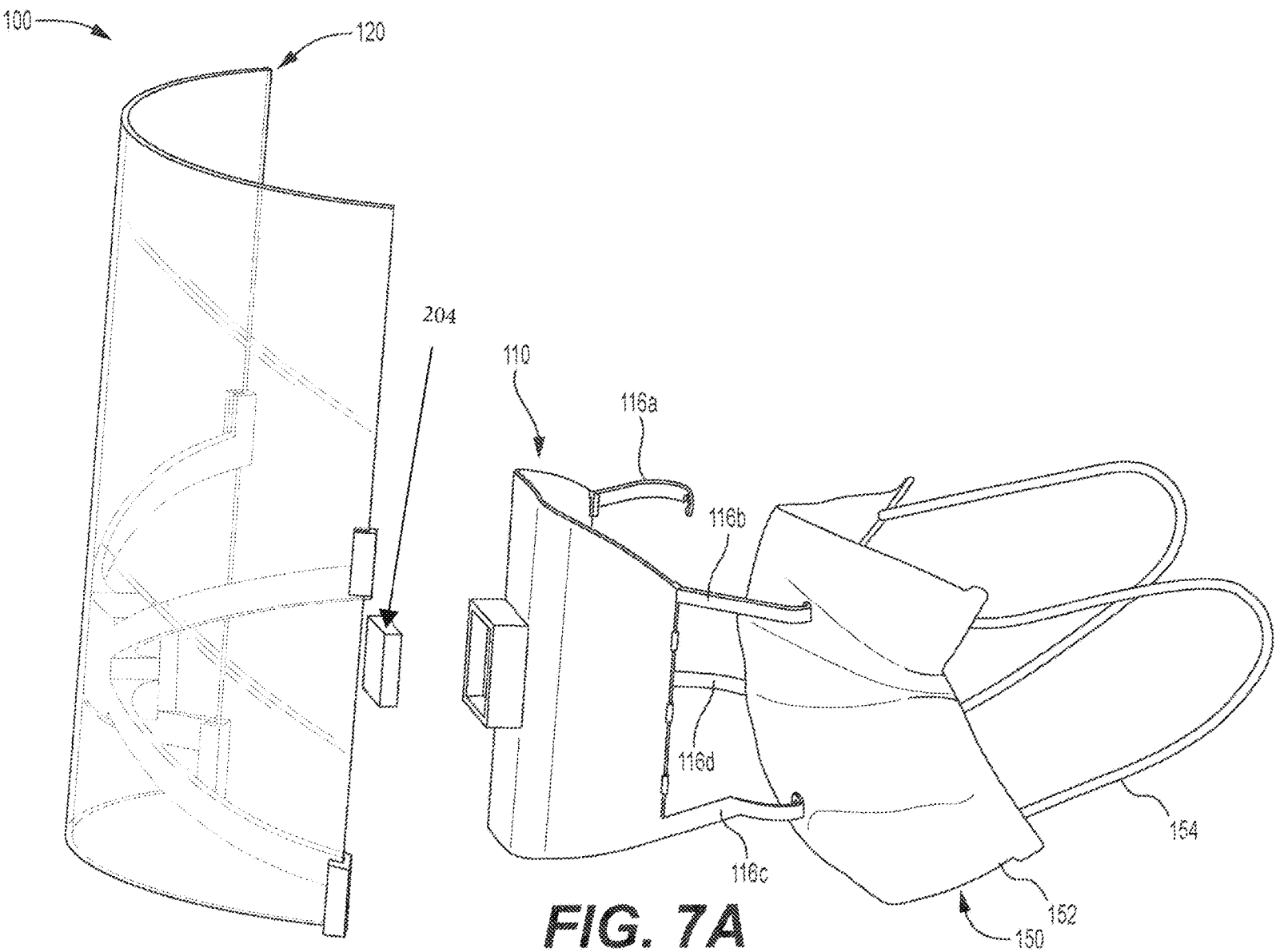
FIG. 7A illustrates a perspective view of the protection system with one or more attachment elements, according to some embodiments of the disclosure.
Figure 7B:
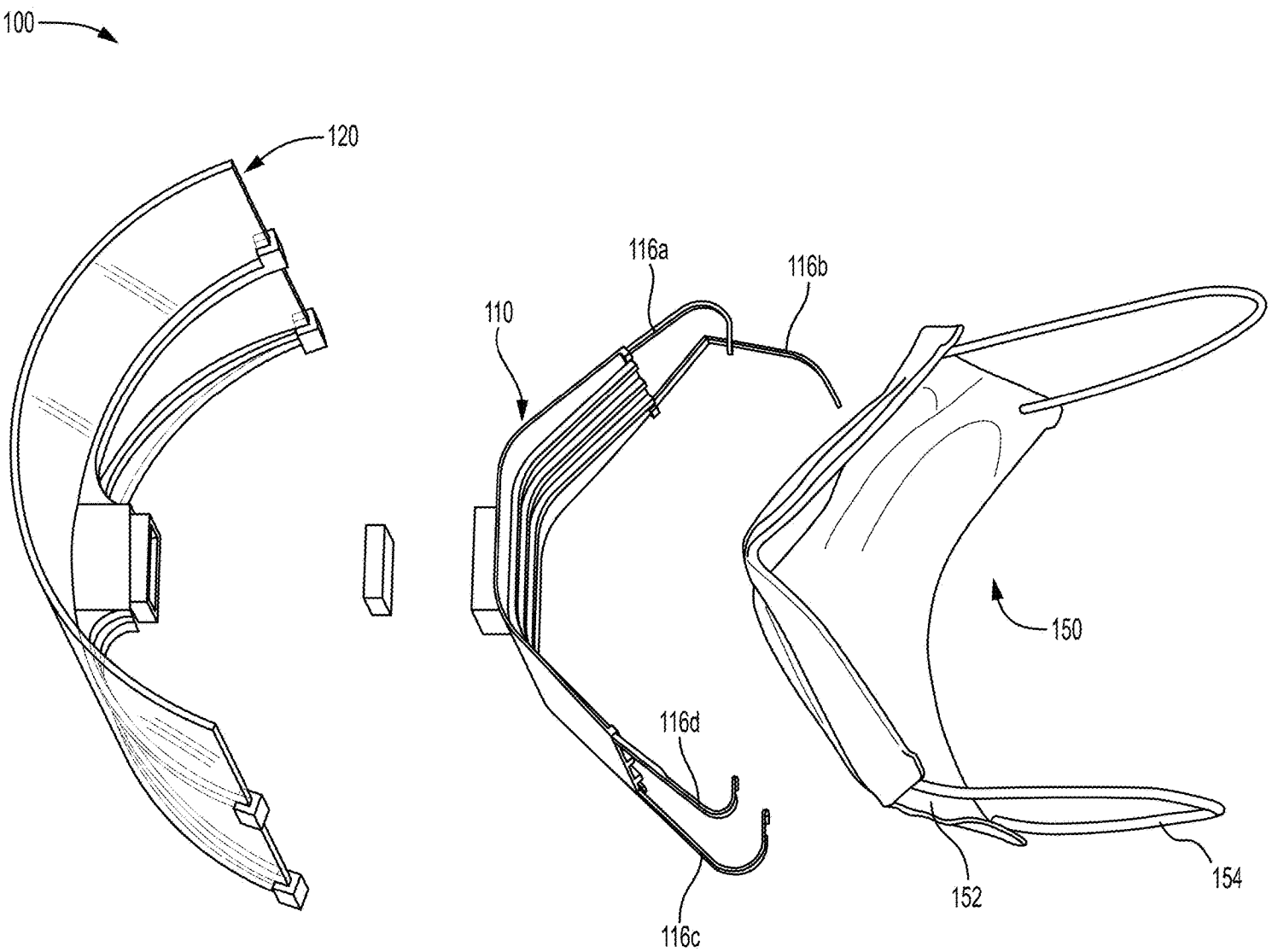
FIG. 7B illustrates a perspective view of the protection system of FIG. 7A.

FIGS. 7A and 7B illustrate perspective views of a protection system 100, including a face shield 120 and a mask 110, according to some embodiments of the disclosure. The face shield 120 is designed to be coupled to a surgical mask 150 through a series of attachment elements 116*a*, 116*b*, 116*c*, and 116*d*. Surgical mask 150 may include main body 152 and securing elements 154. The attachment elements 116*a-d* are configured to hook onto surgical mask 150, ensuring secure engagement by utilizing the tension in the securing elements 154.

In some embodiments, the attachment elements 116*a-d* each include a hook that engages with one or more components of the surgical mask 150. For example, the hooks may secure to the edge of the main body 152 of the mask 150 or loop onto the securing elements 154, such as elastic bands or loops used to attach the surgical mask to the user's head. This configuration allows the face shield 120 to be securely attached to the mask 150, providing enhanced protection without the need for additional headgear.

Figure 7C:
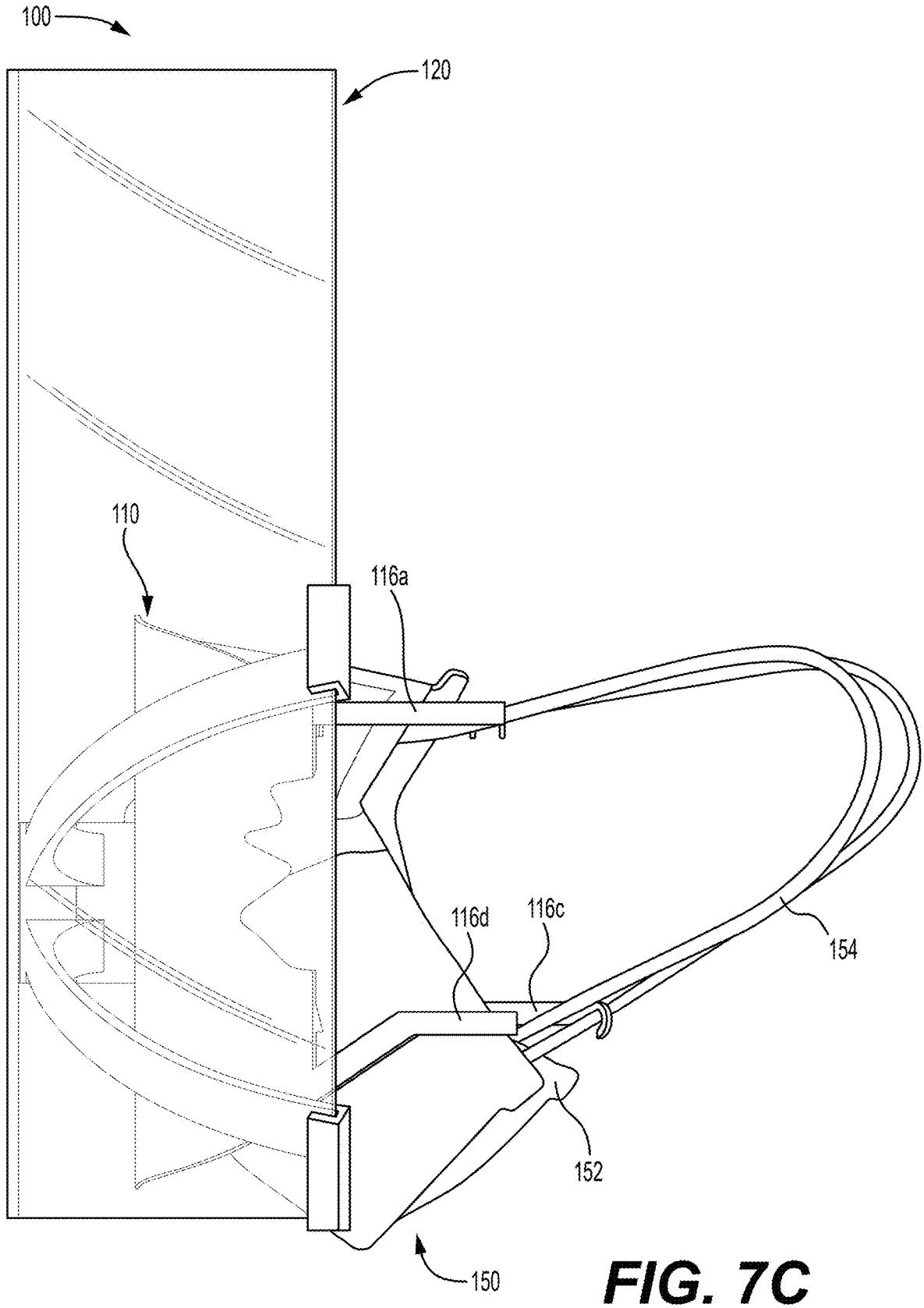
FIG. 7C illustrates a perspective view of the protection system of FIG. 7A, shown in an engaged configuration.

FIG. 7C provides a perspective view of the protection system 100 in an engaged configuration, showcasing the integration of the face shield 120 with the surgical mask 150 via the mask 110. The attachment elements 116*a*, 116*b*, 116*c*, and 116*d* are shown engaging with the securing elements 154 of the surgical mask 150. This view illustrates the spatial relationship and orientation of the components when fully assembled, demonstrating how the tension from the securing elements 154 maintains the attachment of the face shield 120.

FIG. 7C highlights the structural features of the attachment elements 116*a-d*. Each of the attachment elements 116*a-d* includes a hook designed to engage securely with one or more of the main body 152 of the surgical mask 150 or the securing elements 154, which may be elastic bands or loops. The attachment elements 116*a-d* ensure that the face shield 120 remains firmly in place, providing consistent protection during use. The hooks are configured to be selectively and removably attached, allowing for ease of assembly and disassembly.

In some embodiments, the mask 110, from which attachment elements 116*a-d* extend, serves as a central coupling mechanism for the face shield 120. As discussed herein, the mask 110 includes features designed to facilitate a secure and stable attachment to the surgical mask 150. These features ensure that the face shield 120 does not shift or detach during normal use, enhancing the reliability and functionality of the protection system 100. The attachment elements 116*a-d* may vary in length depending on the desired configuration, allowing for customizable fit and coverage.

Figure 7D:
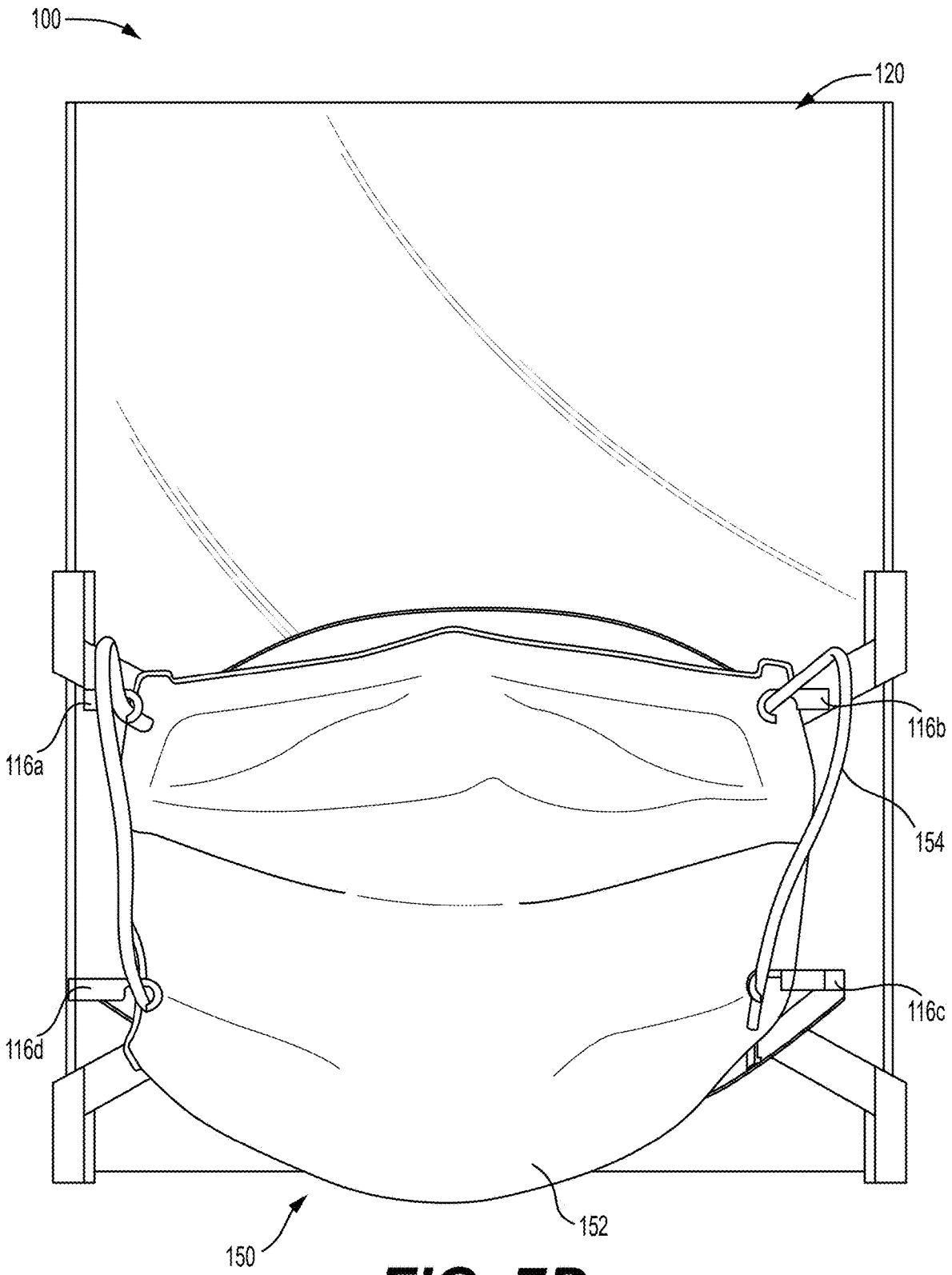
FIG. 7D illustrates a perspective view of the protection system of FIG. 7C.

In some embodiments, FIG. 7D is a rear elevation view of the protection system 100, illustrating the engagement of the face shield 120 with the surgical mask 150 from the perspective of the user. This view emphasizes the points of connection where the attachment elements 116*a-d* hook onto the securing elements 154 of the surgical mask 150. The hooks of the attachment elements 116*a-d* are configured to distribute the tension evenly, ensuring a balanced and comfortable fit for the user.

In some embodiments, the rear elevation view of FIG. 7D provides an illustration of how the attachment elements 116*a-d* interact with one or more of the securing elements 154 and/or the main body 152 to maintain the position of the face shield 120. The hooks of the attachment elements 116*a-d* are positioned to prevent any forward or lateral movement of the face shield 120, ensuring that it remains aligned with the user's face for optimal protection. The attachment elements 116*a-d* may be constructed from various materials, such as plastic, metal, or the like, providing flexibility and durability to the overall assembly.

In some embodiments, mask 110 is designed to work in conjunction with the securing elements 154 of the surgical mask 150, ensuring that the entire assembly is secure yet comfortable for prolonged use. The attachment elements 116*a-d*, with variable lengths and material options, may contribute to the ergonomic fit and adaptability of the protection system 100. In some embodiments, the combination of the face shield 120, mask 110, and surgical mask 150, as illustrated in FIGS. 7*c* and 7*d*, forms a comprehensive protection system that provides both particulate filtration and impact protection, while incorporating one or more aspects of the venting pathways as discussed herein.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the disclosures is by way of example, and the scope of the disclosures is not limited to the exact details depicted or described.

Although the foregoing detailed description of the present disclosure has been described by reference to an exemplary embodiment, and the best mode contemplated for carrying out the present disclosure has been depicted and described, it will be understood that certain changes, modification or variations may be made in embodying the above disclosure, and in the construction thereof, other than those specifically set forth herein, may be achieved by those skilled in the art without departing from the spirit and scope of the disclosure, and that such changes, modification or variations are to be considered as being within the overall scope of the present disclosure. Therefore, it is contemplated to cover the present disclosure and any and all changes, modifications, variations, or equivalents that fall within the true spirit and scope of the underlying principles disclosed and claimed herein. Consequently, the scope of the present disclosure is intended to be limited only by the attached claims, all matter contained in the above description and depicted in the accompanying drawings shall be interpreted as illustrative and not in a limiting sense.

Having now described the features, discoveries and principles of the disclosure, the manner in which the disclosure is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the disclosure herein described, and all statements of the scope of the disclosure which, as a matter of language, might be said to fall therebetween.

What is claimed is:

1. A system comprising:

a face mask configured to cover a nose and mouth of a user, and to conform to a face of a user, the face mask including one or more venting pathways to alter a direction of one or more exhaled gasses traveling in an initial direction, the face mask including an adapter, the adapter including a plurality of second venting pathways, each of the plurality of second venting pathways configured to direct the one or more exhaled gasses in a direction substantially orthogonal to the initial direction;

a face shield, the face shield selectively engageable with the face mask;

a connector including a magnetic engagement structure to couple the face mask to the face shield in a predetermined orientation; and at least one attachment element extending from the face mask, the at least one attachment element configured to selectively engage a surgical mask covering a nose and a mouth of the user such that when the at least one attachment element is selectively engaged with the surgical mask, the face mask is between i) a portion of the surgical mask covering the nose and mouth of the user, and ii) the connector.

2. The system of claim 1, wherein at least one attachment element comprises a plurality of attachment elements configured to selectively engage the surgical mask.

3. The system of claim 2, wherein plurality of attachment elements include a plurality of hooks configured to selectively engage with one or more securing straps of the surgical mask, thereby retaining the face mask in a relative position to the surgical mask when in an engaged configuration.

4. The system of claim 1, wherein the connector further includes a plurality of arms, each of the plurality of arms being flexibly constructed for adaptable engagement with the face shield.

5. The system of claim 4, wherein the connector further includes a friction fit connector.

6. A system comprising:

a surgical mask comprising a main body and securing elements, the securing elements connected to the main body and configured to secure the surgical mask to a head of a user;

a face mask configured to conform to the face of the user, the face mask including one or more venting pathways to alter a direction of one or more exhaled gasses traveling in an initial direction;

a face shield, the face shield selectively engageable with the face mask;

a connector including a magnetic engagement structure to couple the face mask to the face shield in a predetermined orientation, the connector further including a plurality of arms, each of the plurality of arms being flexibly constructed for adaptable engagement with the face shield; and at least one attachment element extending from the face mask, the at least one attachment element selectively engaging the main body of the surgical mask.

7. The system of claim 6, wherein the at least one attachment element selectively engages the surgical mask such that the face mask is between the surgical mask and the connector.

8. The system of claim 6, wherein the face mask further includes an adapter, the adapter including a plurality of second venting pathways, each of the plurality of second venting pathways configured to direct the one or more exhaled gasses in a direction substantially orthogonal to the initial direction.

9. The system of claim 6, wherein at least one attachment element comprises a plurality of attachment elements configured to selectively engage the surgical mask.

10. The system of claim 9, wherein the plurality of attachment elements include a plurality of hooks configured to selectively engage with one or more securing straps of the surgical mask, thereby retaining the face mask in a relative position to the surgical mask when in an engaged configuration.

11. The system of claim 6, wherein the connector further includes a friction fit connector.

12. A system comprising:

a surgical mask configured to conform to a face of a user;

a face mask including one or more venting pathways configured to alter a direction of one or more exhaled gasses traveling in an initial direction, the face mask further including an adapter, the adapter including a plurality of second venting pathways, each of the plurality of second venting pathways configured to direct the one or more exhaled gasses in a direction substantially orthogonal to the initial direction;

a face shield engageable with the face mask;

a connector including an engagement structure to couple the face mask to the face shield in a predetermined orientation; and at least one attachment element extending from the face mask, the at least one attachment element selectively engaging the surgical mask such that the face mask is between the connector and the surgical mask when the surgical mask covers a nose or a mouth of a user.

13. The system of claim 12, wherein at least one attachment element comprises a plurality of attachment elements configured to selectively engage the surgical mask.

14. The system of claim 13, wherein the plurality of attachment elements include a plurality of hooks configured to selectively engage with securing straps of the surgical mask, thereby retaining the face mask in a relative position to the surgical mask when in an engaged configuration.

15. The system of claim 12, wherein the connector further includes a plurality of arms, each of the plurality of arms being flexibly constructed for adaptable engagement with the face shield.

16. The system of claim 15, wherein the connector further includes a friction fit connector.

* * * * *